US007296527B2

(12) United States Patent
Toth

(10) Patent No.: US 7,296,527 B2
(45) Date of Patent: Nov. 20, 2007

(54) APPARATUS AND METHOD FOR SECURING A MOORING LINE OF A VESSEL

(75) Inventor: Thomas Toth, Edithvale (AU)

(73) Assignee: Harbour & Marine Engineering Pty Ltd., East Bentleigh, Victoria (AU)

( * ) Notice: Subject to any disclaimer, the term of this patent is extended or adjusted under 35 U.S.C. 154(b) by 0 days.

(21) Appl. No.: 10/514,033

(22) PCT Filed: Apr. 17, 2003

(86) PCT No.: PCT/AU03/00486

§ 371 (c)(1),
(2), (4) Date: Aug. 2, 2005

(87) PCT Pub. No.: WO03/095300

PCT Pub. Date: Nov. 20, 2003

(65) Prior Publication Data

US 2005/0284355 A1 Dec. 29, 2005

(30) Foreign Application Priority Data

May 9, 2002 (AU) ..... PS2214

(51) Int. Cl.
*B63B 21/00* (2006.01)

(52) U.S. Cl. ..... 114/230.1; 114/199; 114/249

(58) Field of Classification Search ..... 114/199, 114/218, 230.1, 230.25, 230.26, 249, 251
See application file for complete search history.

(56) References Cited

U.S. PATENT DOCUMENTS

| | | | | |
|---|---|---|---|---|
| 4,299,183 | A | 11/1981 | Prock | |
| 4,387,659 | A * | 6/1983 | Terauchi et al. | 114/199 |
| 5,297,499 | A * | 3/1994 | Grange | 114/218 |
| 5,732,647 | A | 3/1998 | Benmno | |
| 5,957,075 | A * | 9/1999 | Byrne et al. | 114/230.25 |
| 6,009,824 | A * | 1/2000 | Ross | 114/218 |

FOREIGN PATENT DOCUMENTS

GB 2 185 950 A 8/1987

OTHER PUBLICATIONS

Derwent Abstract Accession No. 84-193863/31, SU 1057366 A (Gorki River Fleet) Nov. 30, 1983.

* cited by examiner

*Primary Examiner*—Lars A. Olson
(74) *Attorney, Agent, or Firm*—Morris Manning Martin LLP; Tim Tingkang Xia, Esq.

(57) ABSTRACT

There is disclosed, apparatus for securing a mooring line (5) of a vessel, the mooring line having an eye (6), said apparatus comprising a hook (10) around which the eye (6) of the mooring line (5) can be secured, the hook (10) having a pair of hook members (11*a*, 11*b*) defining a gap therebetween, and guide means (15, 17, 9) configured to guide a heaving line attached to said eye along a path which passes through said gap whereby when said heaving line heaves the eye past the hook, the eye locates over the hook.

24 Claims, 6 Drawing Sheets

1
2
3
5
6
7
8
10
13
14
15
16
17
19
20
21
23
24
25
26
28
29
32
33
A
B
C
D

APPARATUS AND METHOD FOR SECURING A MOORING LINE OF A VESSEL

FIELD OF THE INVENTION

The present invention relates to an apparatus and method for securing a mooring line of a vessel.

BACKGROUND OF THE INVENTION

Modern jetties, particularly those handling petroleum, gas or bulk commodities, typically use quick-release mooring hooks to hold vessel lines and restrain the vessel against the jetty face. The mooring hooks are attached to a base which is bolted to the top of the jetty, and are generally associated with a motorised capstan or winch which is used to retrieve heavy mooring lines from an arriving vessel, allowing the eye of the mooring line to be placed over the hook by the mooring crew and subsequently tensioned using the vessel's winches.

The hooks pivot vertically and horizontally to accommodate variations in mooring patterns and the vessel height above the jetty. Typically, these will change as the load in the vessel changes.

The quick-release mooring hooks are designed so that after a locking mechanism is released, the hook rotates so that the bend in the hook faces towards the vessel, thus releasing the eye of the mooring line. The major advantage of the quick-release hook is that lines can be released under full tension, enabling the vessel to depart quickly while retaining maximum control despite counteracting forces from wind, waves, tide or current.

The combination of a quick-release hook and capstan unit (or a winch) provides significant advantages to the safety of jetty personnel, and also increases productivity because of improved vessel turn around times. As such, they have become the industry standard, particularly in petroleum and mineral ports with exposed weather conditions.

While the release mechanism provides an improvement over the prior art, the vessel lines have, up until now, been connected manually to the quick-release hook by a mooring crew, exposing members of the crew to the risk of injury. Particularly, if too much tension comes onto the mooring line as the eye of the mooring lines is being placed over the hook. In such situations, operators are exposed to the serious risk of injury. Particularly, crush injuries involving their hands and fingers. Further, mooring lines are heavy and lifting them can result in back injury.

Accordingly, it would be advantageous to provide an improved technique for securing the mooring line to a mooring hook.

SUMMARY OF THE INVENTION

Accordingly, the invention provides apparatus for securing a mooring line of a vessel, the mooring line having an eye, said apparatus comprising:

a hook around which the eye of the mooring line can be secured, the hook having a pair of hook members defining a gap therebetween; and guide means configured to guide a heaving line attached to said eye along a path which passes through said gap whereby when said heaving line heaves the eye past the hook, the eye locates over the hook.

Preferably, said guide means includes first and second guide members, the first guide member being on a vessel side of the hook, and the second guide member being on the opposite side of the hook to the first guide member, the first and second guide members being located relative to the hook, such that when said heaving line heaves said eye past the hook, the eye is brought to a position below the highest point of said hook to thereby locate the eye over the hook.

Preferably, said first guide member has a mouth aperture which narrows to a throat aperture so that when the eye of the mooring line enters the mouth aperture, it is guided towards the throat aperture.

Preferably, said second guide member is carried by a hooking unit which also carries said hook and defines an upper limit of said path.

Preferably, said first guide member is mounted so that it can pivot vertically relative to said hooking unit.

Preferably, said hooking unit includes a quick-release mechanism for releasing said hooking means.

Preferably, said hooking unit is pivotally mounted to a base member.

Preferably, said hooking unit is both horizontally and vertically pivotally mounted to said base member.

The invention also provides a method for securing a mooring line of a vessel to a hooking means, comprising the steps of:

providing a hook having a pair of hook members defining a gap therebetween;

securing a heaving line to an eye of a mooring line of a vessel; and guiding said heaving line along a path which passes through said gap heaved, whereby when said heaving line heaves the eye past the hook, the eye locates over the hooking means.

The invention also provides a method for upgrading an apparatus for securing a mooring line of a vessel, the mooring line having an eye, the method comprising the steps of:

replacing an existing hook around which the eye of the mooring line can be secured with a new hook having a pair of hook members defining a gap therebetween; and providing guide means configured to guide a heaving line attached to said eye along a path which passes through said gap whereby when said heaving line heaves the eye past the new hook, the eye locates over the new hook.

The invention also provides a kit for upgrading an apparatus for securing a mooring line of a vessel, the mooring line having an eye, said kit comprising:

a hook around which the eye of the mooring line can be secured in use, the hook having a pair of hook members defining a gap therebetween; and guide means configured to guide in use, a heaving line attached to said eye along a path which passes through said gap whereby when said heaving line heaves the eye past the hook, the eye locates over the hook.

Further features of the invention will become apparent from the following description of a preferred embodiment of the invention.

DESCRIPTION OF THE PREFERRED EMBODIMENT

Figures 1, 2:
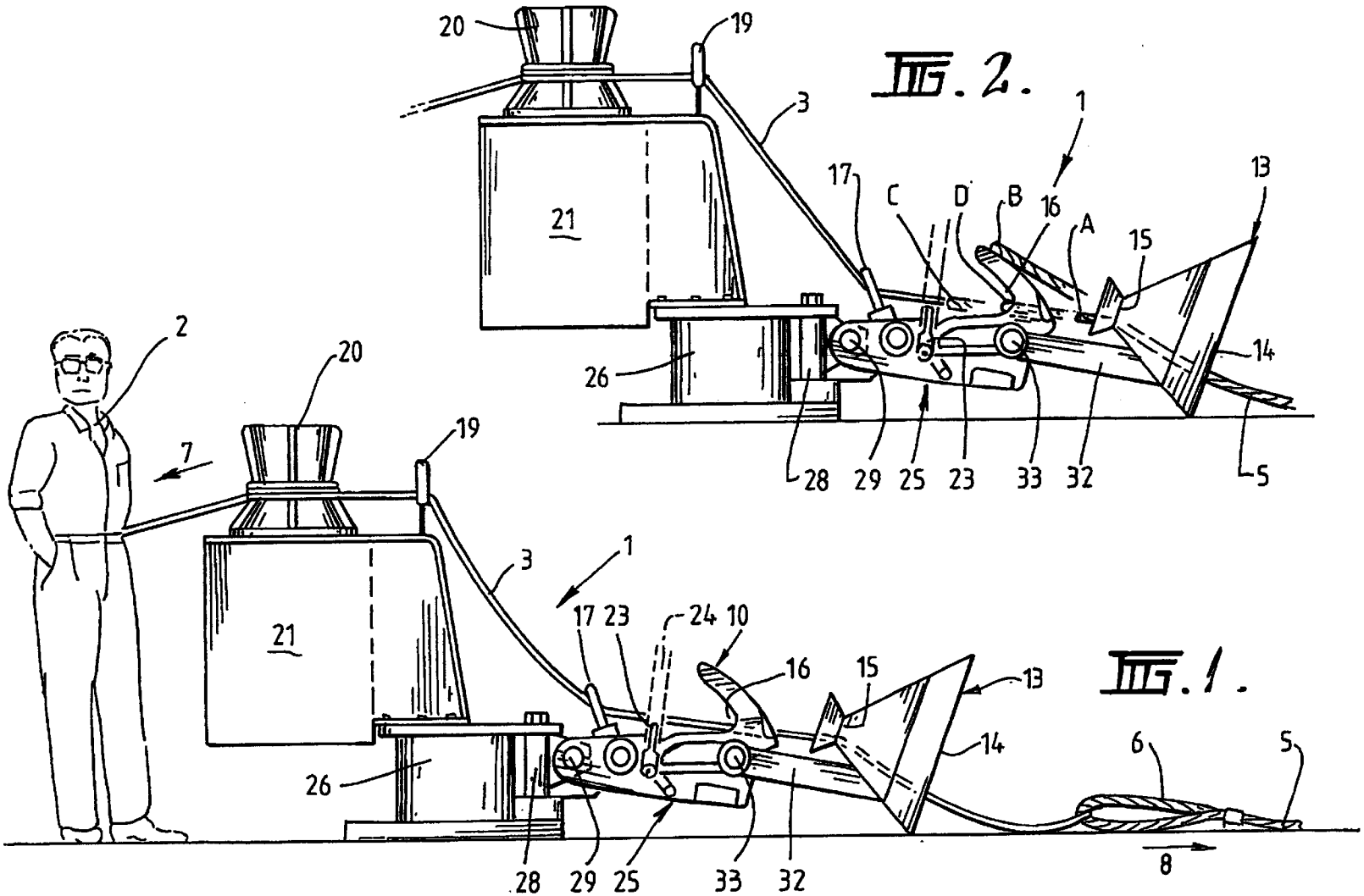
FIG. 1 is a side view showing the apparatus of a first preferred embodiment.
FIG. 2 is a similar side view to FIG. 1 showing the movement of the mooring line through a number of different positions.

The first preferred embodiment provides apparatus for securing a mooring line 5 of a vessel by locating the eye of the mooring line 5 around a quick-release hook 10. The apparatus guides a heaving line 3 so that it heaves the eye 6 of the mooring line 5 along a path which is located relative to the quick-release hook such that the heaving line automatically heaves the eye 6 over the hook 10. When tension is subsequently applied to the mooring line 3, the eye nestles within the bend 16 of the hook 10. Thus, the person 2 or persons operating the apparatus do not have to handle the heavy mooring line 5, nor handle the heaving line 3 while it is under tension.

Referring to FIG. 1, a heaving line 3 is secured to the eye 6 of the mooring line 5. The operator 2 feeds the heaving line through the mouth 14 of guide box 13, and then through the throat 15 of the guide box, which provides a first guide member on the vessel side of the hook 9.

Figure 7:
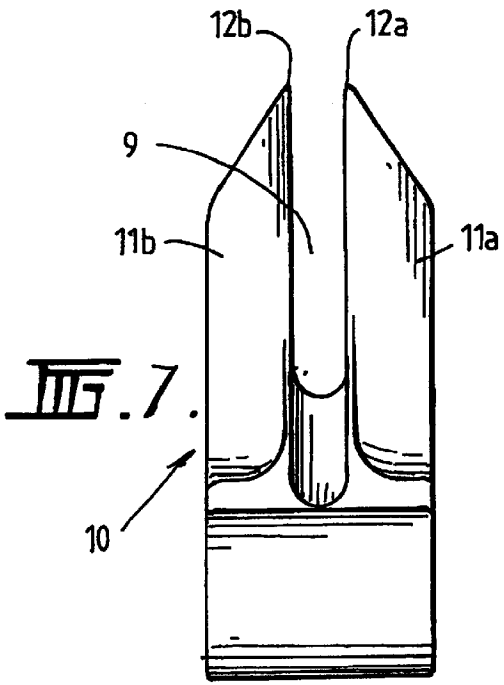
FIG. 7 is a front view of the hook of the first preferred embodiment.
Figure 6:
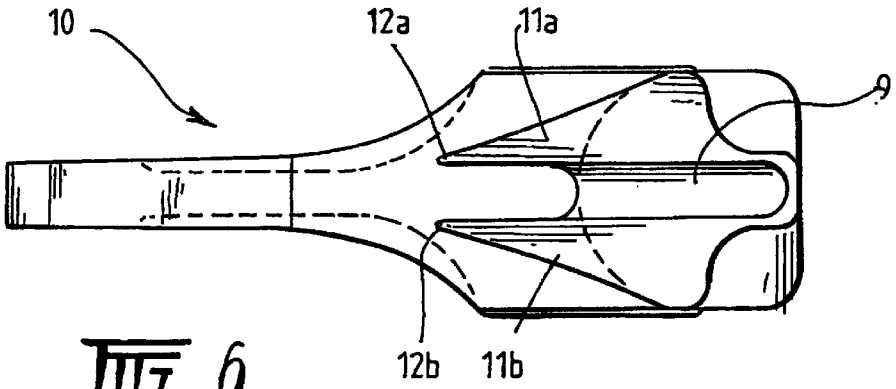
FIG. 6 is a plan view of the hook of the first preferred embodiment.
Figure 5:
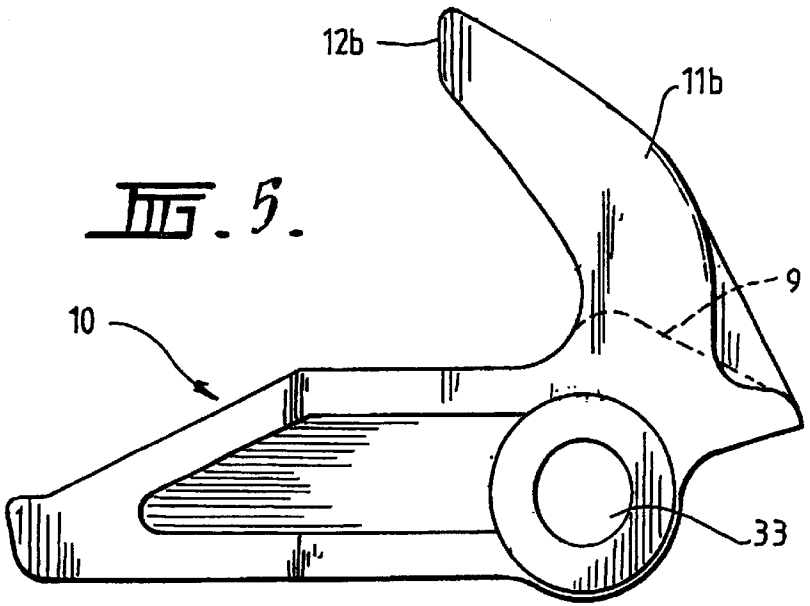
FIG. 5 is a side view of the hook of the first preferred embodiment.

As shown in FIGS. 5 through 7, the hook 10 has a pair of hook members 11*a*, 11*b* defining a gap 9 therebetween. The operator 2 feeds the heaving line 3 through the gap 9 in the hook 10 and then under a second guide member in the form of guide bar 17 before feeding it through capstan guide bar 19 and wrapping it around capstan head 20, which forms part of capstan 21.

Thus, the throat 15, the guide bar 17 and the gap 9 collectively act as a guide means which define a path along which the heaving line travels. In this respect, it will be appreciated that the heaving line 3 has some freedom of movement within this path. The purpose of the guide means is twofold. Firstly, the throat 15 and the guide bar 17 are located below the tips 12*a*, 12*b* of the hook members 11*a*, 11*b* to ensure that the heaving line passes within gap 9, and further, to ensure that when the eye 6 is heaved past the tips 12 of the hook 10, the eye 6 will drop below the tips 12 so that it subsequently will locate within bend 16 of hook 10 when the mooring line 5 is under tension. Secondly the gap 9 between the hook members 11*a*, 11*b* ensures that the eye 6 does not fall to either side of the hook 10 and is directed into the correct position.

FIG. 2 shows how the eye 6 is moved into position over the hook 10. At position A, the eye 6 has passed through the throat 15 of the guide box as it is heaved by the heaving line 3. The heaving line 3 then brings the eye 6 into contact with the hook 10. At this point, the eye 6 rides up the hook 10 towards the tips 12*a*, 12*b* (position B). It will be appreciated that the heaving line 3 is caused to temporarily deviate from its original path through the gap, however, the guide bar causes the heaving line 3 to return to its initial position as the eye 6 is heaved past the hook 10, (position C). In position C, the eye 6 is now located over the hook 10.

Note that in position C, the heaving line 3 is still under tension between the mooring line eye 6 and the capstan head 20. The operator 2 then stops the capstan head 20 and (typically), reverses the capstan head 20 to let the tension out of the heaving line so that the eye 6 will locate within the bend 16 of the hook 10 (position D). It will not be necessary to reverse the capstan head 20 in all instances—for example the tension on mooring line 5 may be sufficient to pull the eye into the bend 16 (position D).

Figure 3:
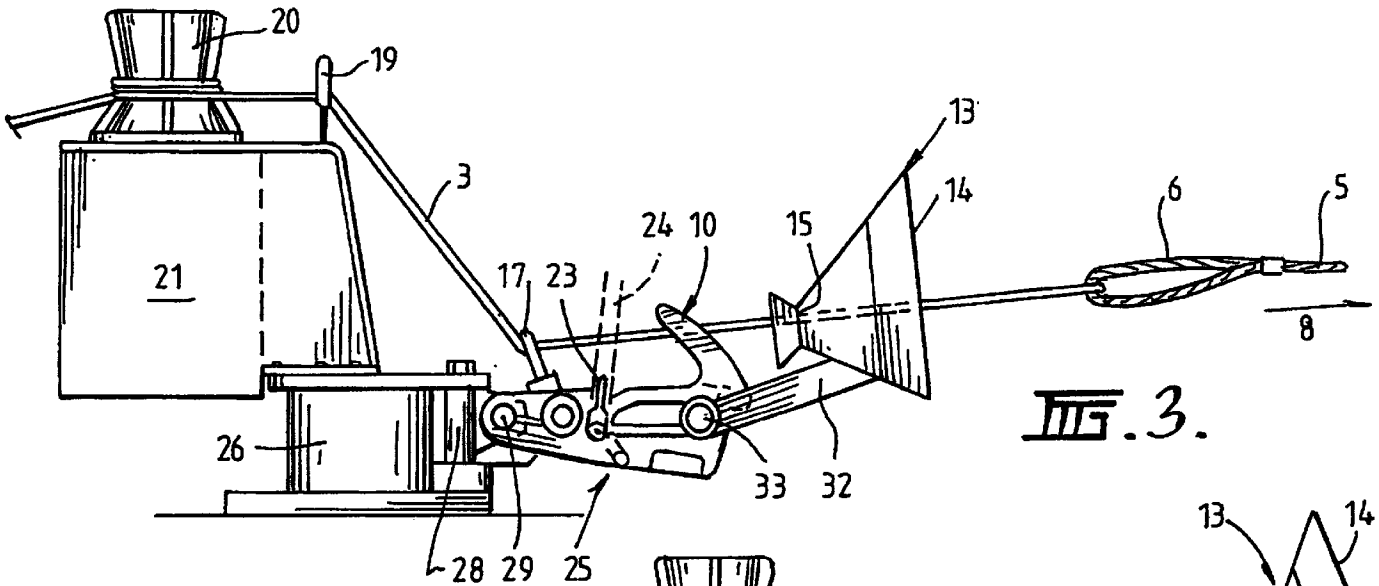
FIGS. 3 and 4 are further side views showing the apparatus of the first preferred embodiment securing a mooring line at a relatively steep angle.
Figure 4:
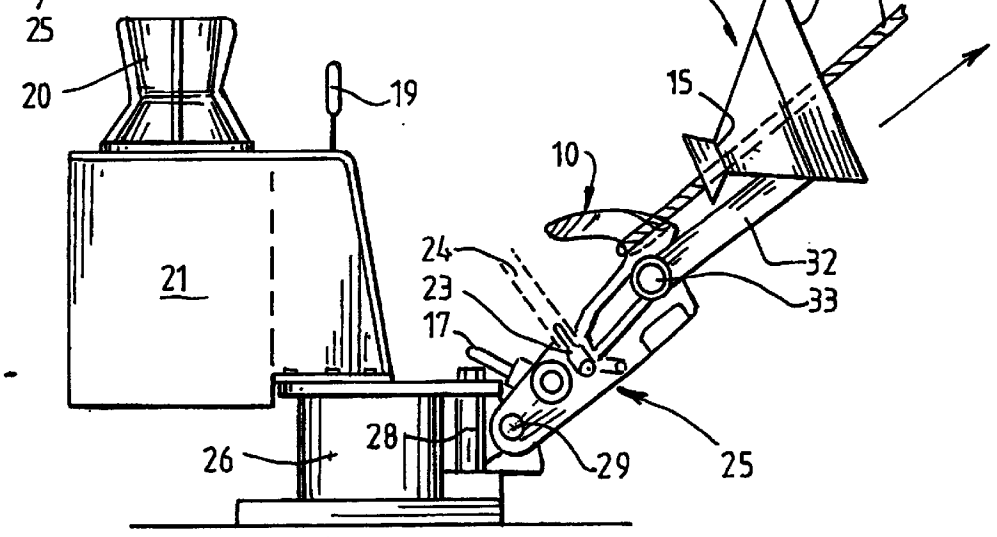

FIGS. 3 and 4 illustrate show the various pivot mountings employed in the apparatus. The guide box 13 which is carried by a pair of guide box arms 32*a*, 32*b* is pivotally mounted to the hook unit 28 around guide box vertical pivot mounting point 33. This means that, as shown in FIG. 3, when the heaving line 3 abuts the inside of the throat 15, the guide box 13 is able to pivot vertically around mounting point 33. Thus, the heaving line 3 is only burdened by the weight of the guide box 13 and not by the additional weight of the hook unit 25 as the eye 6 is being heaved.

As shown in FIG. 4, once the eye is located around the hook, the hook assembly pivots around hook unit vertical pivot point 29. Horizontal movement is permitted by horizontal pivot mounting point 28 where the hook unit is mounted to a base unit 26 which is firmly secured to the jetty.

It will be apparent to persons skilled in the art that the extent to which pivoting is permitted around pivot points 33, 28 and 29 will depend on the requirements of the jetty.

Figure 8:
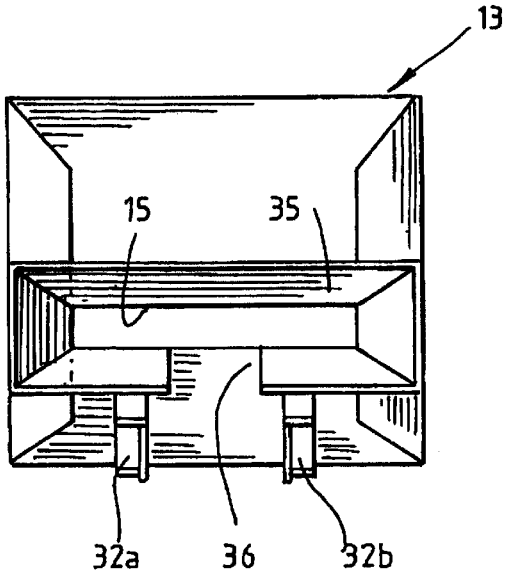
FIG. 8 is a rear view of the guide box of the first preferred embodiment.
Figure 9:
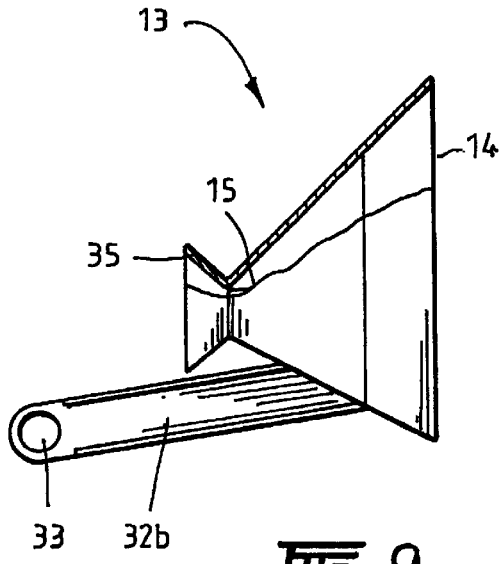
FIG. 9 is a side view of the guide box of the first preferred embodiment.
Figure 10:
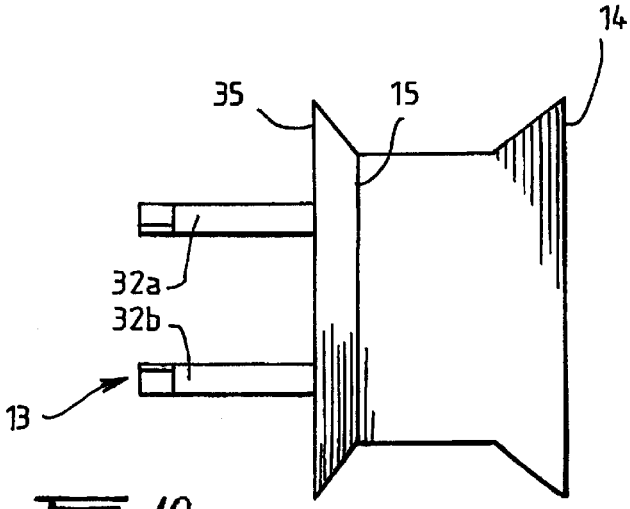
FIG. 10 is a plan view of the guide box of the first preferred embodiment.

The guide box 13 is shown in further detail in FIGS. 8 through 10. The relative width of the mouth 14 to the throat 15 and the angles defined between the perimeter of the throat and perimeter of the mouth allow the heaving line to be brought into position from a wide variety of different angles relative to the apparatus 1.

The guide box 13 also includes a rear mouth 35 to ensure that the mooring line is guided through the guide box when it is released from the hook 35 and does not snag on the guide box.

As explained previously, the apparatus of the present invention is designed specifically for use with a known quick-release hook.

As such quick-release mechanisms are well known, the release mechanism is not illustrated in detail in the present application. In general terms, the release mechanism is locked by moving locking spigot 23 into a locked position. As indicated by dotted lines 24, a locking handle can be placed over the locking spigot in order to actuate the spigot. When the locking spigot is subsequently moved using the handle 24 to the release position, the tips 12*a*,12*b* of the hook 10 rotates toward the vessel so that the bend 16 in the hook 10 points towards the vessel and the eye 6 releases. The tension on the mooring line 5 causes the mooring line to be drawn through the reverse mouth 35 and out of the guide box 13. A cut-out portion 36 is provided in the mouth 35 to accommodate movement of the hook 10 as it rotates towards the vessel.

A second preferred embodiment will now be described in relation to FIGS. 11 to 15 to the extent that this embodiment differs from the first preferred embodiment.

Figures 11, 12, 13:
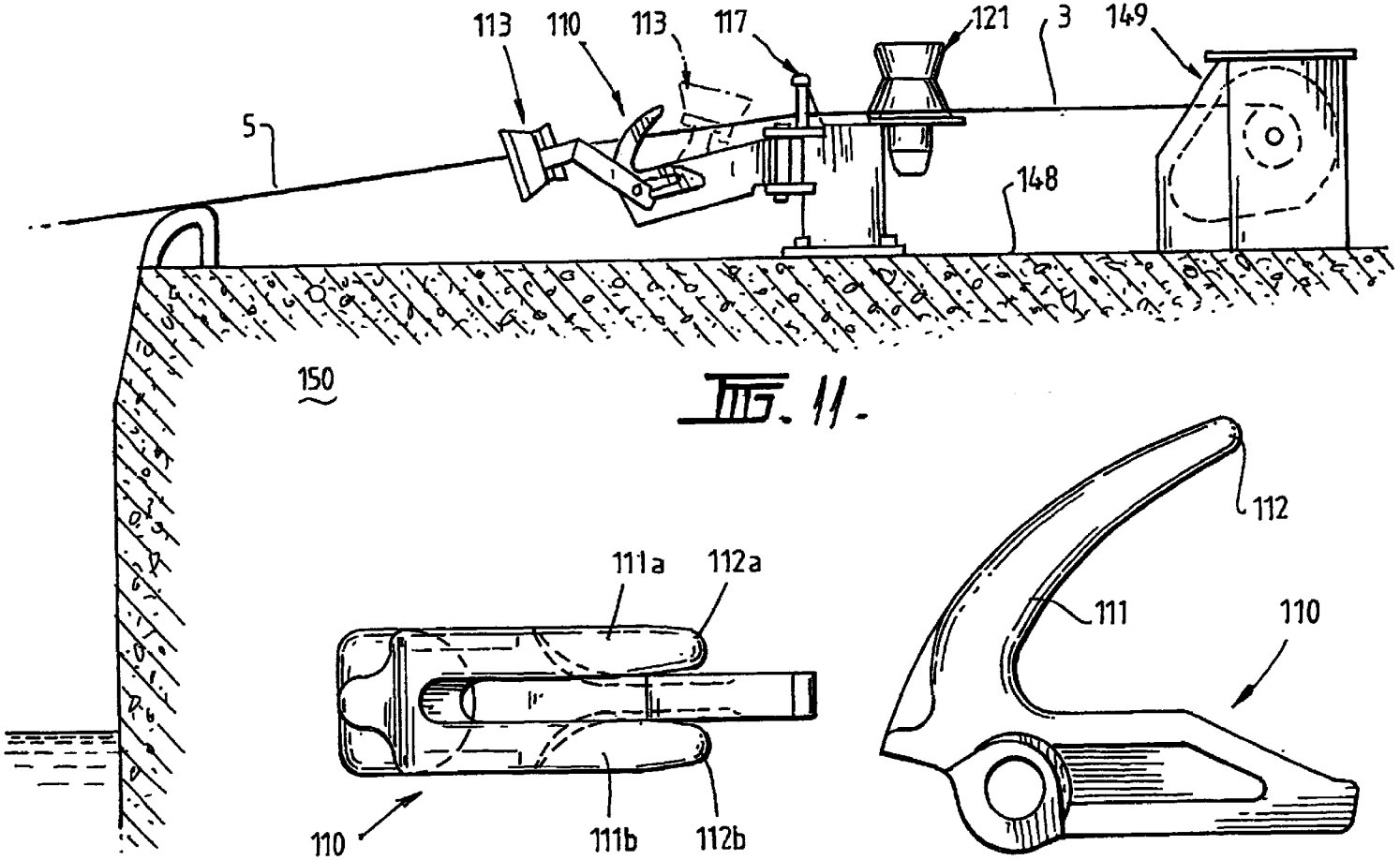
FIG. 11 is a side view of the apparatus of the second preferred embodiment mounted to a jetty.
FIG. 12 is a plan view of a hook of a second preferred embodiment.
FIG. 13 is a side view of the hook of FIG. 12.

FIG. 11 shows an apparatus 101 of the second preferred embodiment. The apparatus is mounted to a jetty 150. The apparatus is mounted so that pivot point 129 is located sufficient above the jetty surface 148 to allow the hook unit to pivot downwards. In addition to the capstan unit 121 there is additionally provided a winch unit 149.

In this embodiment, the second guide member 117 is mounted substantially at the pivot point 129 instead of to the hooking unit and has guide rollers instead of a simple guide bar.

Figure 14:
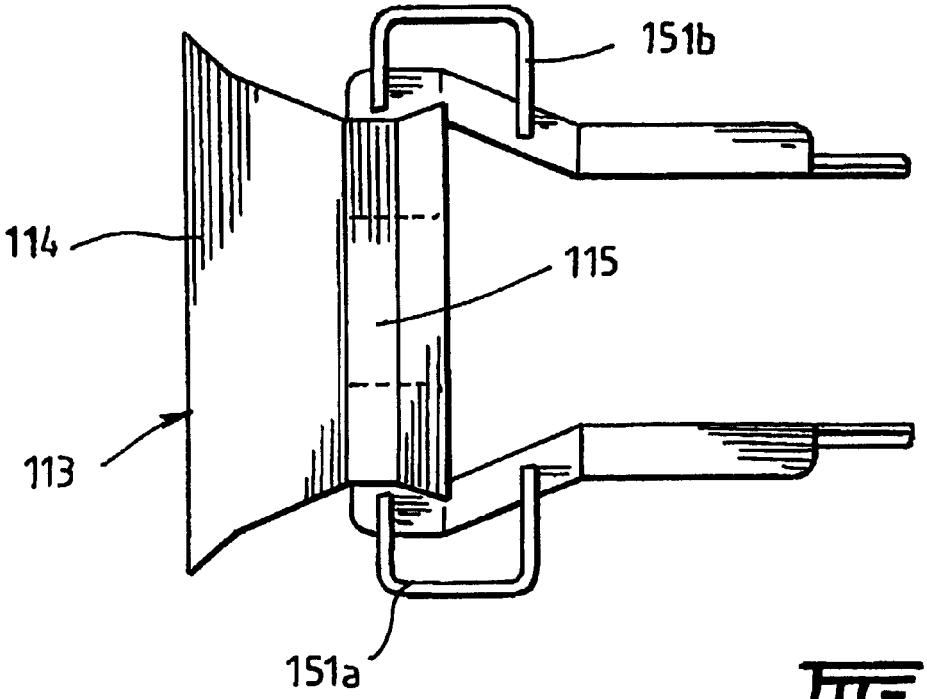
FIG. 14 is a plan view of a guide box of the second preferred embodiment.

Further differences are illustrated in FIGS. 12 through 14. In particular, it will be noted that the hook members 111*a*, 111*b* are longer than the hook members of the first preferred embodiment to increase the hooking capability of the hook. Further, the tips 112*a*,112*b* are smoother than the tips of the hook of the first preferred embodiment.

Figure 15:
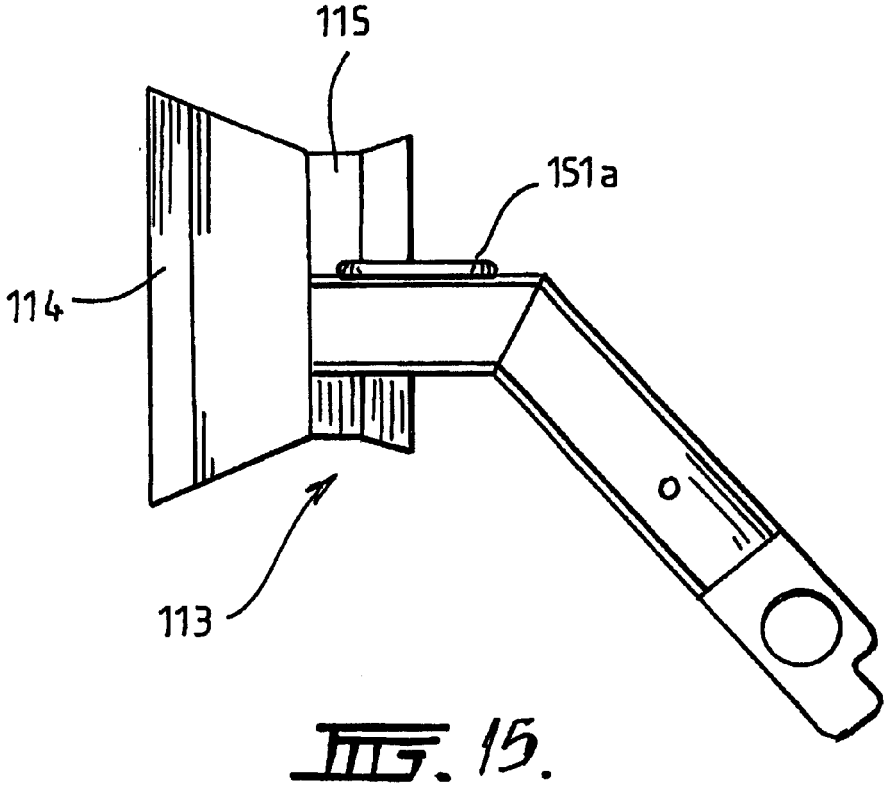
FIG. 15 is a side view of the guide box of FIG. 14.

Referring to FIG. 15, it will be noted that the guide box 113 is generally of a more squat configuration than the guide box of the first embodiment and does not narrow to the same extent.

The guide box has the additional feature of a pair of handles 151*a*,151*b* which can be used to manipulate the guide box 113 into position.

It will also be noted that the guide plates flare increasingly outwardly nearer the mouth 114 of the guide box.

While FIGS. 11 to 15 illustrate some preferred variations on the first preferred embodiment, it will be apparent that various other modifications may be made. For example, in some embodiments where the heaving line is expected to always be below the guide box, it may not be necessary to have a guide member such as a guide bar on the side of the hook opposite to the vessel. Or indeed, it will not be necessary to use any guide member which is provided on that side.

Further, rather than a guide box per se there may be a series of guide plates which define an aperture or a guide roller fairlead which also defines a mouth and throat aperture.

Still further, rather than the single hook which is illustrated for the purposes of illustrating the present invention, an actual installation may include two, three or four hooks or may include a back to back mounted hook assembly.

The apparatus may also be provided with sensor switch or limit switch which prevents the eye from being pulled too far beyond the hook. The limit switch would be tripped by the mooring rope's eye and the switch would cut the power to the capstan or winch automatically.

The guide box may also be provided with electric or hydraulic actuators to manipulate and position the box in order to assist in the guiding or aligning of the rope eye. This may also be provided if a fairlead is used.

Various other modifications will be apparent. For example, the guide bar 17 and capstan of guide 19 could be replaced with guide rollers. Further, the capstan head 20 may be mounted so that it rotates in a vertical plane rather than a horizontal plane.

Still further, the hook members of the split hook could be designed to fold down when contacted by the eye as the eye is being heaved into place. For example, the hook members could be pivotally mounted and spring loaded so that they return to their normal position once the eye has passed.

Further, it will be appreciated that the apparatus of the present invention may be provided in kit form for upgrading an existing apparatus. That is the kit could consist of a split hook having a pair of hook members which define a gap which can replace an existing hook as well as guide means which can be welded or bolted to an existing unit. For example, the kit could include a guide box with mounts for mounting the guide box to an existing unit as well as guide bars or guide rollers which could be mounted to the existing unit. The various guide members and other component parts of the kit would be adapted so that they can be attached to an existing apparatus. For example, bolt holes may be provided in various of the components to the apparatus to facilitate it being bolted to an existing apparatus.

It will also be appreciated that the apparatus of the present invention can be used to replace an existing hook unit while maintaining the support structure and capstan/winch.

These and other modifications will be apparent to persons skilled in the art, and should be considered as falling within the scope of the invention described herein.

The claims defining the invention are as follows:

1. Apparatus for securing a mooring line of a vessel, the mooring line having an eye, said apparatus comprising:

a hook around which the eye of the mooring line can be secured, the hook having a pair of hook members defining a gap therebetween; and guide means configured to guide a heaving line attached to said eye along a path which passes through said gap whereby when said heaving line heaves the eye past the hook, the eye locates over the hook, wherein said guide means includes first and second guide members, the first guide member being on a vessel side of the hook, and the second guide member being on the opposite side of the hook to the first guide member, the first and second guide members being located relative to the hook, such that when said heaving line heaves said eye past the hook, the eye is brought to a position below the highest point of said hook to thereby locate the eye over the hook; and wherein said first guide member is mounted so that it can pivot vertically relative to said hook.

2. Apparatus for securing a mooring line of a vessel, the mooring line having an eye, said apparatus comprising:

a hook around which the eye of the mooring line can be secured, the hook having a pair of hook members defining a gap therebetween; and guide means configured to guide a heaving line attached to said eye along a path which passes through said gap whereby when said heaving line heaves the eye past the hook, the eye locates over the hook wherein said hook is operably connected to a quick-release mechanism for releasing said hook.

3. Apparatus for securing a mooring line of a vessel, the mooring line having an eye, said apparatus comprising:

a hook around which the eye of the mooring line can be secured, the hook having a pair of hook members defining a gap therebetween; and guide means configured to guide a heaving line attached to said eye along a path which passes through said gap whereby when said heaving line heaves the eye past the hook, the eye locates over the hook, wherein said guide means includes first and second guide members, the first guide member being on a vessel side of the hook, and the second guide member being on the opposite side of the hook to the first guide member, the first and second guide members being located relative to the hook, such that when said heaving line heaves said eye past the hook, the eye is brought to a position below the highest point of said hook to thereby locate the eye over the hook;

wherein said second guide member is carried by a hooking unit which also carries said hook and defines an upper limit of said path; and wherein said hooking unit is pivotally mounted to a base member.

4. Apparatus as claimed in claim 3, wherein said hooking unit is both horizontally and vertically pivotally mounted to said base member.

5. Apparatus for securing a mooring line of a vessel, the mooring line having an eye, said apparatus comprising:

a hook around which the eye of the mooring line can be secured, the hook having a pair of hook members defining a gap therebetween; and guide means configured to guide a heaving line attached to said eye along a path which passes through said gap whereby when said heaving line heaves the eye past the hook, the eye locates over the hook, wherein said guide means includes first and second guide members, the first guide member being on a vessel side of the hook, and the second guide member being on the opposite side of the hook to the first guide member, the first and second guide members being located relative to the hook, such that when said heaving line heaves said eye past the hook, the eye is brought to a position below the highest point of said hook to thereby locate the eye over the hook; and wherein said first guide member comprises a plurality of guide plates.

6. Apparatus for securing a mooring line of a vessel, the mooring line having an eye, said apparatus comprising:

a hook around which the eye of the mooring line can be secured, the hook having a pair of hook members defining a gap therebetween; and guide means configured to guide a heaving line attached to said eye along a path which passes through said gap whereby when said heaving line heaves the eye past the hook, the eye locates over the hook, wherein said guide means includes first and second guide members, the first guide member being on a vessel side of the hook, and the second guide member being on the opposite side of the hook to the first guide member, the first and second guide members being located relative to the hook, such that when said heaving line heaves said eye past the hook, the eye is brought to a position below the highest point of said hook to thereby locate the eye over the hook; and wherein said first guide member is a guide roller fairlead.

7. Apparatus for securing a mooring line of a vessel, the mooring line having an eye, said apparatus comprising:

a hook around which the eye of the mooring line can be secured, the hook having a pair of hook members defining a gap therebetween; and guide means configured to guide a heaving line attached to said eye along a path which passes through said gap whereby when said heaving line heaves the eye past the hook, the eye locates over the hook, wherein said guide means includes first and second guide members, the first guide member being on a vessel side of the hook, and the second guide member being on the opposite side of the hook to the first guide member, the first and second guide members being located relative to the hook, such that when said heaving line heaves said eye past the hook, the eye is brought to a position below the highest point of said hook to thereby locate the eye over the hook, wherein said second guide member is carried by a hooking unit which also carries said hook and defines an upper limit of said path; and wherein said second guide member is a guide roller.

8. Apparatus for securing a mooring line of a vessel, the mooring line having an eye, said apparatus comprising:

a hook around which the eye of the mooring line can be secured, the hook having a pair of hook members defining a gap therebetween; and guide means configured to guide a heaving line attached to said eye along a path which passes through said gap whereby when said heaving line heaves the eye past the hook, the eye locates over the hook, wherein said guide means comprises a guide member on a vessel side of said apparatus, the guide member defining a mouth aperture which narrows to a throat aperture whereby, when the eye of the mooring line enters the mouth aperture, the eye is guided towards the throat aperture; and wherein said guide member is mounted so that the guide member can pivot vertically relative to said hook.

9. Apparatus as claimed in claim 8, wherein said guide member is a guide roller fairlead.

10. Apparatus as claimed in claim 8, wherein said guide member is a guide box.

11. Apparatus as claimed in claim 8, wherein said guide member is a guide roller.

12. A kit for upgrading an apparatus for securing a mooring line of a vessel, the mooring line having an eye, said kit comprising:

a hook around which the eye of the mooring line can be secured in use, the hook having a pair of hook members defining a gap therebetween;

guide means configured to guide in use, a heaving line attached to said eye along a path which passes through said gap whereby when said heaving line heaves the eye past the hook, the eye locates over the hook, wherein said guide means includes first and second guide members, the first guide member being adapted to be installed on a vessel side of the hook, and the second guide member being adapted to be installed on the opposite side of the hook to the first guide member, whereby the first and second guide members being located relative to the hook, such that when said heaving line heaves said eve past the hook, the eve is brought to a position below the highest point of said hook to thereby locate the eye over the hook; and mounting means for mounting said first guide member so that it can pivot vertically relative to said hook.

13. A kit for upgrading an apparatus for securing a mooring line of a vessel, the mooring line having an eye, said kit comprising:

a hook around which the eye of the mooring line can be secured in use, the hook having a pair of hook members defining a gap therebetween; and guide means configured to guide in use, a heaving line attached to said eye along a path which passes through said gap whereby when said heaving line heaves the eye past the hook, the eye locates over the hook, wherein said guide means includes first and second guide members, the first guide member being adapted to be installed on a vessel side of the hook, and the second guide member being adapted to be installed on the opposite side of the hook to the first guide member, whereby the first and second guide members being located relative to the hook, such that when said heaving line heaves said eye past the hook, the eye is brought to a position below the highest point of said hook to thereby locate the eye over the hook; and wherein said first guide member comprises a plurality of guide plates.

14. A kit for upgrading an apparatus for securing a mooring line of a vessel, the mooring line having an eye, said kit comprising:

a hook around which the eye of the mooring line can be secured in use, the hook having a pair of hook members defining a gap therebetween; and guide means configured to guide in use, a heaving line attached to said eye along a path which passes through said gap whereby when said heaving line heaves the eye past the hook, the eye locates over the hook, wherein said guide means includes first and second guide members, the first guide member being adapted to be installed on a vessel side of the hook, and the second guide member being adapted to be installed on the opposite side of the hook to the first guide member, whereby the first and second guide members being located relative to the hook, such that when said heaving line heaves said eye past the hook, the eye is brought to a position below the highest point of said hook to thereby locate the eye over the hook; and wherein said first guide member is a guide roller fairlead.

15. A kit for upgrading an apparatus for securing a mooring line of a vessel, the mooring line having an eye, said kit comprising:

a hook around which the eye of the mooring line can be secured in use, the hook having a pair of hook members defining a gap therebetween; and guide means configured to guide in use, a heaving line attached to said eye along a path which passes through said gap whereby when said heaving line heaves the eye past the hook, the eye locates over the hook, wherein said guide means includes first and second guide members, the first guide member being adapted to be installed on a vessel side of the hook, and the second guide member being adapted to be installed on the opposite side of the hook to the first guide member, whereby the first and second guide members being located relative to the hook, such that when said heaving line heaves said eye past the hook, the eye is brought to a position below the highest point of said hook to thereby locate the eye over the hook;

wherein said second guide member is adapted to define an upper limit of said path; and wherein said second guide member is a guide roller.

16. A kit for upgrading an apparatus for securing a mooring line of a vessel, the mooring line having an eye, said kit comprising:

a hook around which the eye of the mooring line can be secured in use, the hook having a pair of hook members defining a gap therebetween;

guide means configured to guide in use, a heaving line attached to said eye along a path which passes through said gap whereby when said heaving line heaves the eye past the hook, the eye locates over the hook, wherein said guide means comprises a guide member adapted to be installed on a vessel side of said apparatus, the guide member defining a mouth aperture which narrows to a throat aperture whereby, when the eye of the mooring line enters the mouth aperture, the eye is guided towards the throat aperture; and mounting means for mounting said guide member so that the guide member can pivot vertically relative to said hook.

17. A kit as claimed in claim 16, wherein said guide member is a guide roller fairlead.

18. A kit as claimed in claim 16, wherein said guide member is a guide box.

19. A kit as claimed in claim 16, wherein said guide member is a guide roller.

20. Apparatus for securing a mooring line of a vessel, the mooring line having an eye, said apparatus comprising:

a hook around which the eye of the mooring line can be secured, the hook having a pair of hook members defining a gap therebetween; and guide means configured to guide a heaving line attached to said eye along a path which passes through said gap whereby when said heaving line heaves the eye past the hook, the eye locates over the hook, wherein the hook is shaped so that the eye of the mooring line rides up the hook towards tips of the hook members as the heaving line heaves the eye past the hook.

21. A method for securing a mooring line of a vessel to a hooking means, comprising the steps of:

providing a hook having a pair of hook members defining a gap therebetween;

securing a heaving line to an eye of a mooring line of a vessel;

guiding said heaving line along a path which passes through said gap heaved, whereby when said heaving line heaves the eye past the hook, the eye locates over the hooking means; and guiding said heaving line along a path such that the eye of the mooring line rides up the hook towards tips of the hook members as the heaving line heaves the eye past the hook.

22. A method for upgrading an apparatus for securing a mooring line of a vessel, the mooring line having an eye, the method comprising the steps of:

replacing an existing hook around which the eye of the mooring line can be secured with a new hook having a pair of hook members defining a gap therebetween; and providing guide means configured to guide a heaving line attached to said eye along a path which passes through said gap whereby when said heaving line heaves the eye past the new hook, the eye locates over the new hook, wherein the hook is shaped so that the eye of the mooring line rides up the hook towards tips of the hook members as the heaving line heaves the eye past the hook.

23. A method for upgrading an apparatus for securing a mooring line of a vessel, the mooring line having an eye, the method comprising the steps of:

replacing an existing hook around which the eye of the mooring line can be secured with a new hook having a pair of hook members defining a gap therebetween; and providing guide means configured to guide a heaving line attached to said eye along a path which passes through said gap whereby when said heaving line heaves the eye past the new hook, the eye locates over the new hook, wherein said hook is operably connected to a quick-release mechanism for releasing said hook.

24. A kit for upgrading an apparatus for securing a mooring line of a vessel, the mooring line having an eye, said kit comprising:

a hook around which the eye of the mooring line can be secured in use, the hook having a pair of hook members defining a gap therebetween; and guide means configured to guide in use, a heaving line attached to said eye along a path which passes through said gap whereby when said heaving line heaves the eye past the hook, the eye locates over the hook, wherein said hook is operably connected to a quick-release mechanism for releasing swing hook.

* * * * *